United States Patent [19]

Bucknam

[11] 4,088,217

[45] May 9, 1978

[54] TYPEWRITER ATTACHMENT

[76] Inventor: Ralph E. Bucknam, Crescent Beach Dr., Huntington, N.Y. 11743

[21] Appl. No.: 765,279

[22] Filed: Feb. 3, 1977

[51] Int. Cl.[2] ..... B41J 1/60

[52] U.S. Cl. ..... 400/161.1; 400/717; 400/110; 400/175

[58] Field of Search ..... 197/1 R, 1 A, 16, 18, 197/55, 48–49, 180, 181.2

[56] References Cited

U.S. PATENT DOCUMENTS

| | | | |
|---|---|---|---|
| 3,631,956 | 1/1972 | Choi | 197/1 A |
| 3,645,372 | 2/1972 | Noell et al. | 197/18 |
| 3,731,778 | 5/1973 | Willcox | 197/16 |
| 3,892,303 | 7/1975 | Willcox | 197/18 |

OTHER PUBLICATIONS

Harris, et al., "Type Font Tray" IBM Tech. Discl. Bull., vol. 17, No. 5, Oct. 1974, p. 1266.

*Primary Examiner*—Paul T. Sewell
*Attorney, Agent, or Firm*—Bucknam and Archer

[57] ABSTRACT

The device of the present invention is intended to be attached to a ball-element type typewriter to permit rapid switching among a plurality of ball elements. While the invention has utility in any instance where the need arises for switching rapidly and frequently among a number of ball elements, it is particularly useful in systems as described for utilization of a standard typewriter for typing Chinese or Japanese.

4 Claims, 7 Drawing Figures

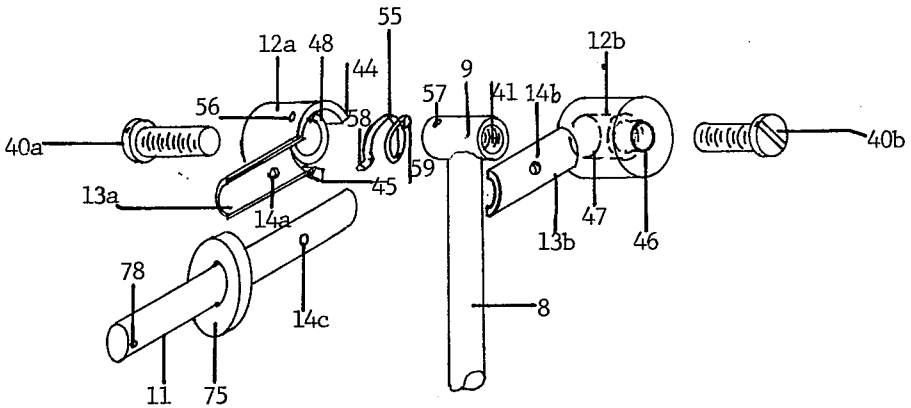
FIG 6
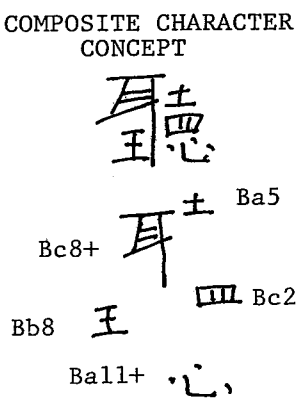
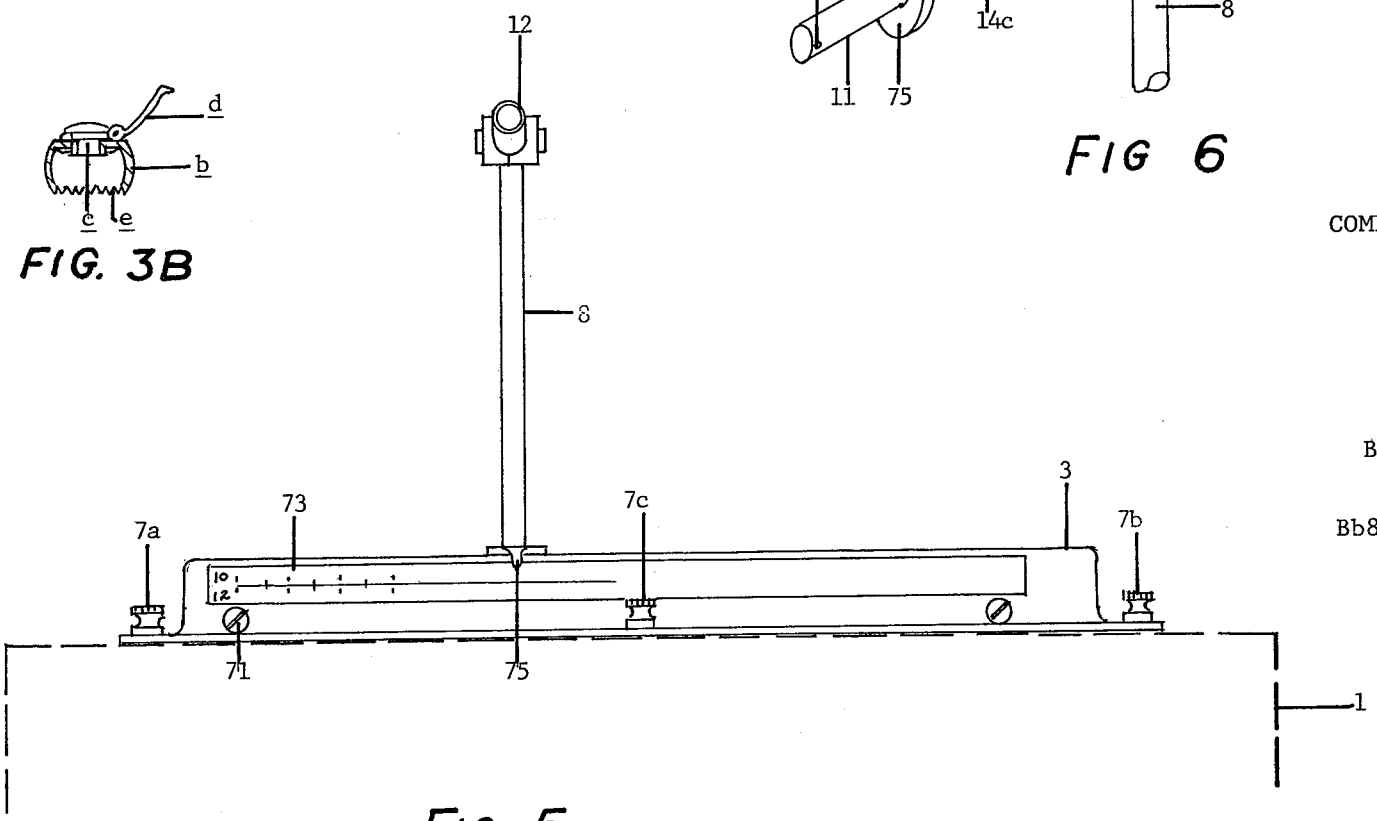
FIG. 5
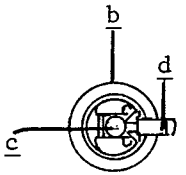
FIG. 3A
FIG. 3B

TYPEWRITER ATTACHMENT

SUMMARY OF THE INVENTION

The nature and substance of the invention resides in a device which may be quickly and firmly assembled to a standard ball-type typewriter such as the International Business Machines Corporation typewriter sold under the trademark "SELECTRIC" II or, alternatively, incorporated as a permanent part of such typewriter. The device comprises a ball support normally adapted to hold a combination of selected types of ball elements in a position clear of the area where the paper is moved and where the typing takes place. When a shift from one ball element to another is required, the device facilitates removing the presently operative ball element to a remote position, indexing the device quickly and accurately to permit rapid placement of another selected ball element in the operative position, and quickly returning the device to its position clear of the work area. Means are provided for adjusting the transverse position of the device to agree with the position of the operative ball element. While by suitable gearing, this can be accomplished automatically, for present purposes hand operation is satisfactory.

While the invention has utility in various fields such as the typing of complex mathematical or chemical formulas, a particularly significant use and the one which will be described in detail herein is in the typing of the Chinese language. By minor modifications, the same utiliy can be realized in the typing of the Japanese language.

According to the present invention there is provided a device for supporting a plurality of ball-type typing elements on a typewriter of the moving ball type in positions normally remote from the work area, wherein the improvement comprises means for permitting movement of an empty ball support member into position to receive a ball located in operative position in the typewriter and permitting subsequent movement to said remote position, means permitting another ball support carrying a selected ball to be moved into said operative position and for returning said other ball support in empty condition to said remote position, and means for positioning said device in alignment with said operative ball element transversely of the typewriter.

DRAWINGS

In order that the invention may be fully understood and readily carried into effect reference is made to the accompanying drawings in which:

FIG. 3A is a plan view of a standard typing element of the ball type.

FIG. 3B is an elevation in cross section of the element of FIG. 3A.

FIG. 5 is a front elevation of the stanchion slide assembly and stanchion as mounted on the typewriter.

FIG. 6 is an exploded view of the pivot member located at the top of the stanchion.

DETAILED DESCRIPTION

Figure 1:
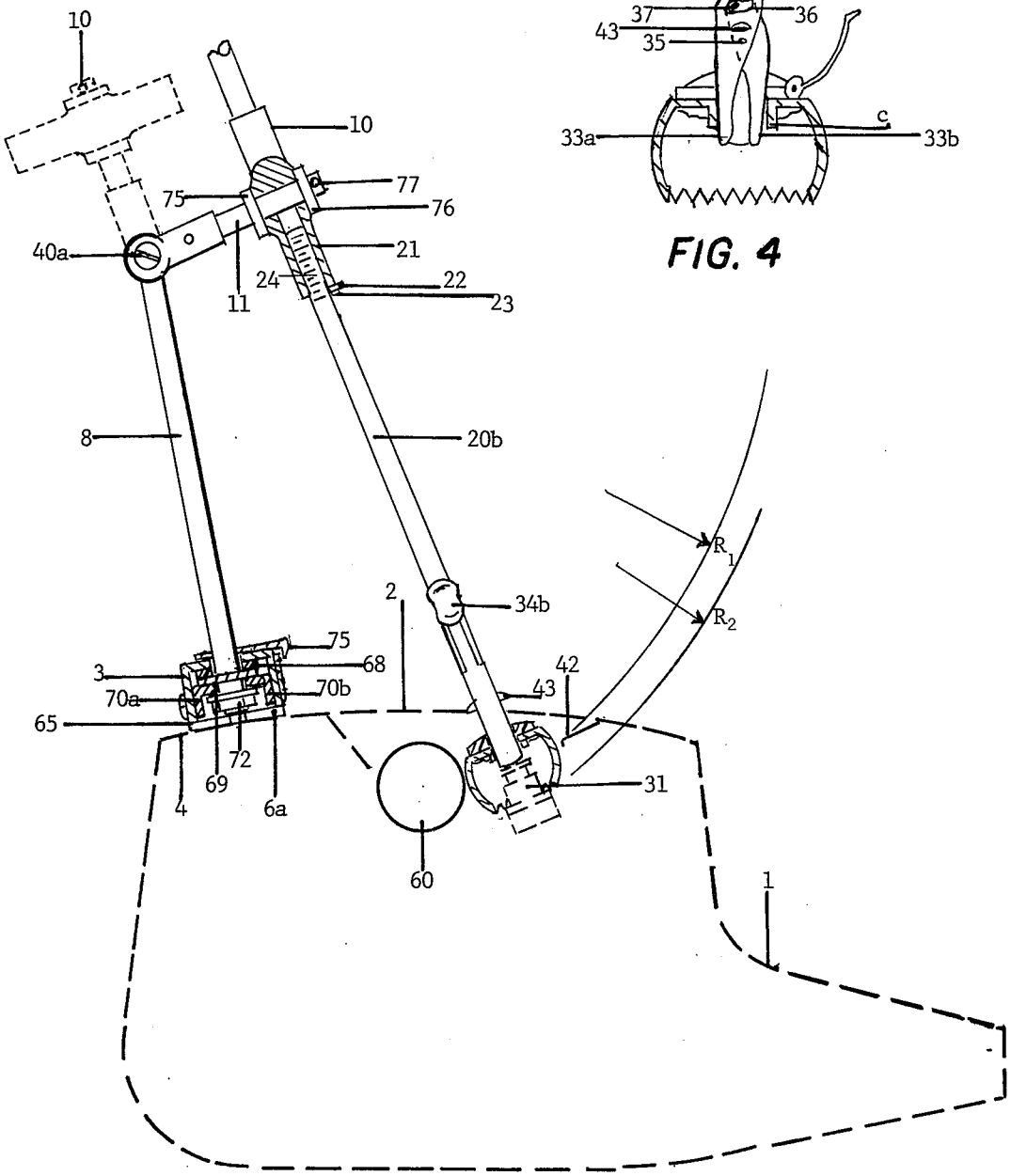
FIG. 1 is a side elevation view showing the attachment mounted on a standard movable ball type typewriter.
Figure 2:
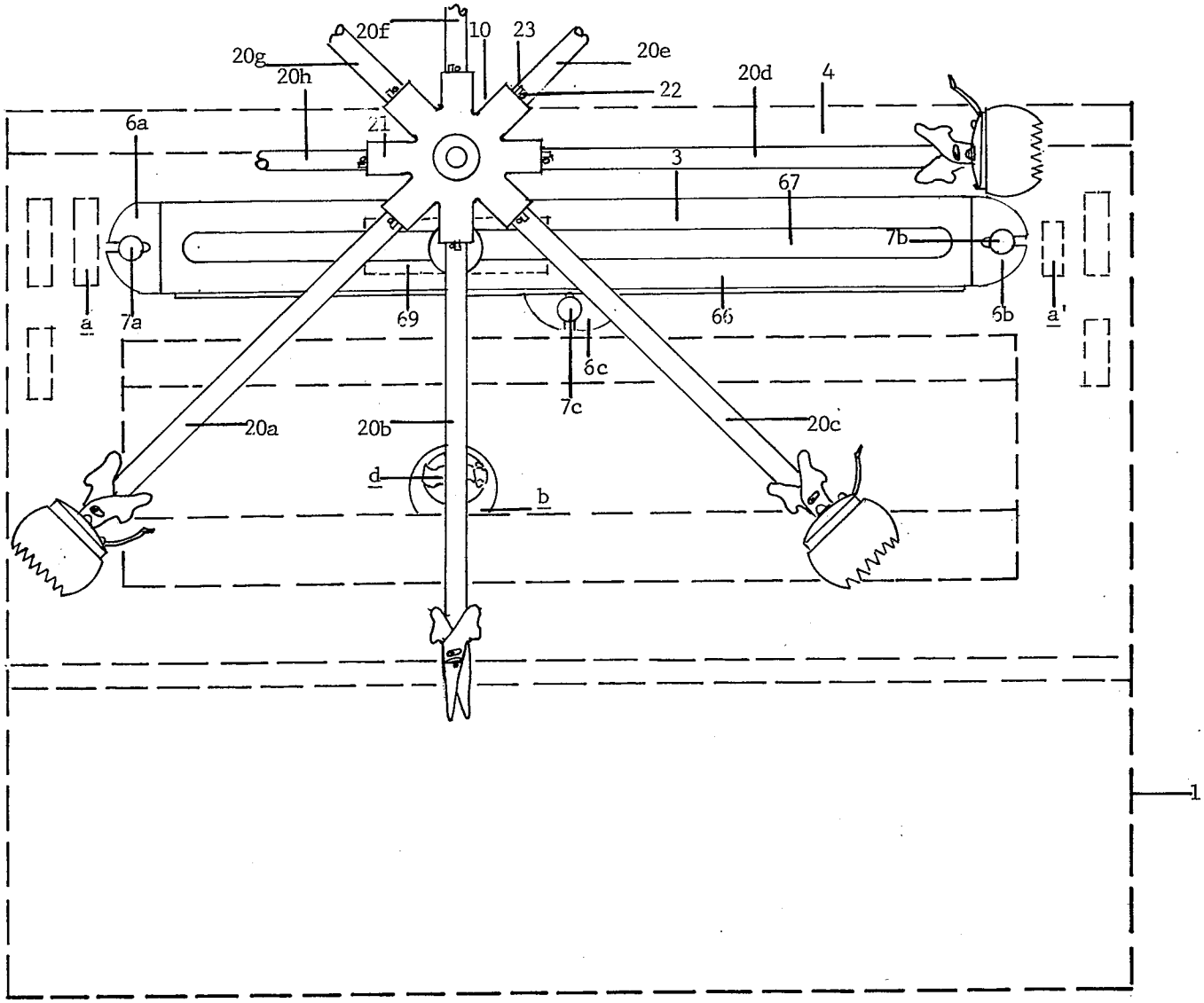
FIG. 2 is a plan view of the structure shown in FIG. 1.

Referring to FIG. 1 there is shown in dash lines only so much of a standard moving ball type typewriter as will suffice to reveal the connection therewith of the attachment of the present invention. The top profile 2 of the standard typewriter to which the invention is being applied is curved. A stanchion slide assembly or guide means 3 is mounted thereon. As seen in FIG. 2, stanchion slide assembly 3 extends transversely of the typewriter. On the standard typewriter being used for demonstration, the transverse distance between the two inner operator slots *a* and *a'* measures approximately 45.5cm. To accomodate the invention to this typewriter, the over-all transverse length of the stanchion slide assembly 3 may be 41cm. The center-line of the base of the stanchion slide assembly 3 can advantageously be positioned approximately along the center-line of the back top surface 4 of the typewriter which, in the typewriter shown, is a distance 3.25cm. forward from the rear edge of the typewriter.

As can be seen in FIGS. 2 and 5, the stanchion slide assembly 3 is provided with three slotted flanges **6*a*, 6*b* and 6*c* permitting assembly of screw members 7*a*, 7*b* and 7*c* to the top surface 4 of the typewriter. The top surface 4 must be modified to receive these screw members. This is the only modification required. As shown, screw members 7*a* and 7*b* should fit in the respective slotted flanges 6*a* and 6*b* at the opposite ends of stanchion slide assembly 3. Slotted flange 6*c* can conveniently extend forwardly so that its slot and screw member 7*c*** will fall on the center line of the typewriter.

Referring again to FIG. 1, due to curvature profile 2 of the typewriter, a stanchion 8 mounted on stanchion slide assembly 3 is shown canted rearwardly at an angle of approximately 12° to the vertical. To ensure adequate clearance for paper, the length of the stanchion should be preferably about 20cm.

In FIG. 1 screw member **7*a* has been omitted and all parts of stanchion slide assembly 3 except slotted flange 6*a*** have been shown in section.

As best seen in FIG. 6, a stanchion pivot 9 is provided at the top of stanchion 8. Ball support assembly 10, rotatably mounted on a support axel 11, is adapted to swing through an arc of approximately 90° by virtue of pivot assembly 12 comprising segments **12*a* and 12*b* seen in FIG. 6. Support axel 11 is received in sleeves 13*a*, 13*b* of pivot assembly 12 and held against movement with respect thereto by a pin (not shown) extending through holes 14*a*, 14*b* of the sleeves and passage 14*c* in said support axel 11**.

Removably received in ball support 10 are a plurality of ball support members **20*a* to 20*h*. While eight such members are shown, ball support 10 can be designed to receive a greater or lesser number. Each ball support member is received in a corresponding tubular extension 21 of ball support 10. It is important that the axial orientation of each tubular extension 21 and its corresponding ball support member be quickly and accurately established during assembly. While many bayonet-type arrangements are available for achieving this objective, a simple approach is to provide a projecting pin 22 on each ball support member, for example ball support member 22*b* as shown in FIG. 1, and to provide a projection 23 extending axially a predetermined distance from the tubular extension 21. Each ball support member 20*a* to 20*h* may be precisely threaded so that the threads 24 draw it into tight engagement with the corresponding tubular extension 21 at the precise position where pin 22 engages projection 23**.

Figure 4:
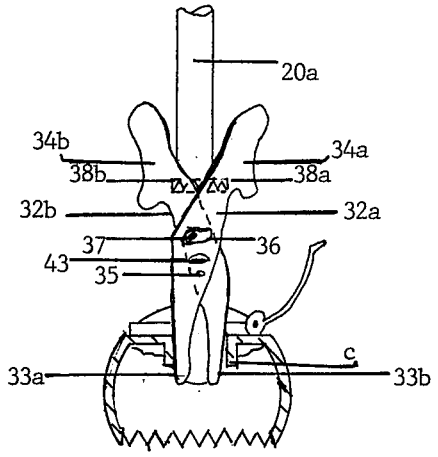
FIG. 4 is an enlarged view of the ball-releasing assembly of the present invention.

At the lower end of each ball support member 20, as can be seen from FIGS. 1 and 4, there is provided a ball-releasing assembly 30. The purpose of this assembly is to permit quick and accurate positioning on and removal from the standard ball stud 31 of a standard typing element of the ball type.

Since some readers may not be familiar with the detailed construction and mode of assembly of such standard typing elements, a brief description is given with reference to FIGS. 3A and 3B. The ball *b* carrying the type font on its outer surface is provided with a tubular recess *c* adapted to be received by ball stud 31 of the typewriter. A spring biased lever *d* is adapted to be selectively positioned either in the open position as shown in FIG. 3B or in the closed operating position as shown with respect to ball support member 20*b* in FIG. 2. Wire springs (not shown) serve both to establish said alternative positions of lever *d* and to clamp the ball element to ball stud 31 when the operating position is established. The teeth *e* are for indexing purposes.

The ball-releasing assembly 30 comprises an outer scissor member 32*a* and an inner scissor member 32*b*. The inner scissor member 32*b* is adapted to receive the corresponding ball support member, for example member 20*a*. The outer scissor member 32*a* is adapted to fit around the inner scissor member 32*b*. The lower ends of the inner and outer scissor members 32*a* and 32*b* are formed to engage annular recess *c* of the ball element. The recess *c* is provided with a shallow groove and also a slot at its lower extremity (neither of which have been shown) and, if desired, the inner scissor member 32*b* or outer scissor member 32*a* can be provided with a protrusion to engage either the groove or the slot. At the respective upper portions of scissor members 32*a* and 32*b* are provided pressure surfaces 34*a* and 34*b* adapted for comfortable engagement between the thumb and finger of the operator. As shown, a pivot pin 35 extends transversely through the outer and inner scissor members 32*a* and 32*b* and through the center line of ball support member 20 so that the assembly can be operated as a "scissor" device. A slot 36 is provided in outer scissor member 32*a* at a convenient position above pivot pin 35 and a stop pin 37 projects from the outer surface of inner scissor member 32*b* into said slot. The position of stop pin 37 in slot 36 is carefully coordinated with the position and shape of holders 33*a* and 33*b* so that, when the assembly is in scissor-open position, said holders will firmly engage annular recess *c* of the ball. Spring receiving recesses 38*a* and 38*b* are provided in scissor members 32*a* and 32*b* in alignment with a transverse passage through ball support member 20 and a compression spring (shown only diagramatically) extending through said passage normally forces scissor members 32*a* and 32*b* to open-scissor position. Pressure exerted by the operator on pressure surfaces 34*a* and 34*b* causes holders 33*a* and 33*b* to release their grip on the ball element.

As best seen from FIG. 6, when the pivot assembly 12 is in operative position, it is secured by screws 40*a* and 40*b* received in threaded interior 41 of stanchion pivot 9. As shown in FIG. 1, screw 40*a* delineates the axis of vertical rotation of ball support 10. In the typewriter with respect to which the invention is being demonstrated, there is a front slope 42 of the top profile the rear lip of which measures a distance of approximately 16.5cm. from the rear edge of the typewriter and approximately 1cm. downward from the top profile 2. As shown in FIG. 1, the end of ball support member 20 should be chosen so as to discribe an arc of radius $R_1$ when the assembly is pivoted about screw 40*a*. The lower edge of the ball element when initially released from ball stud 31 by the operator and raised only sufficiently to clear said stud through manipulation of lever *d* of the element will at that stage assume a position substantially below the rear lip of front slope 42. An arc of movement having a radius $R_2$ would be prohibited. A ball stop 43 must therefor be provided on ball-releasing assembly 30 to ensure that the ball element is raised to proper height for clearance of said rear lip before the ball support 10 is pivoted away from the operative position. Preferably ball stop 43 comprises projections from either or both sides of outer scissor member 32*a*. Its position can be determined by carefully ascertaining the value of $R_2$–$R_1$ which, as shown, is approximately 1.25cm.

As illustrated in FIG. 1, the ball support 10 should be rotatable through approximately 90° to the position shown in broken lines, all ball support members 20*a* to 20*h* being omitted from said broken line showing. Control of the extent of this movement is achieved by cutting away a portion 44–45 of pivotal segment 12*a* and cutting away a corresponding portion (not shown) of pivotal segment 12*b*. The cut portion 45 should extend approximately 12° forward of the vertical, and the arc of the cut out segment should be approximately 90° plus the diameter of stanchion 8. As shown with respect to pivotal segment 12*b*, each segment has a smooth cylindrical passage 46 adapted to rotatably receive the corresponding screw 40 and a passage 47 communicating therewith and adapted to rotatably receive the corresponding end of stanchion pivot 9. To provide for automatic rotation of the ball support 10 to the remote position shown in broken lines, pivotal segment 12*a* is provided with an undercut section 48 adapted to receive a torsion spring 55. Holes 56 and 57 respectively in the outer surfaces of pivotal segment 12*a* and stanchion pivot 9 are provided for receiving ends 58 and 59 of torsion spring 55.

In operation, the ball element moves transversely of the roller 60 shown in FIG. 1. Provision is made for sliding stanchion 8 along the stanchion slide assembly 3 to maintain alignment with the position of the operative ball element as shown by the relative positions of ball support member 20*b* and ball *b* in FIG. 2.

While stanchion slide assembly 3 is correctly shown in FIGS. 1 and 5 as canted rearwardly at said angle of approximately 12°, this slight cant has been ignored in the plan view of FIG. 2 both in regard to stanchion slide assembly 3 and in regard to the showing of ball support 10 to avoid intricate but meaningless complexity in the drawing. As seen in FIG. 1, stanchion slide assembly 3 comprises a rectangular box section 65 including at its ends and center the slotted flanges 6*a*, 6*b* and 6*c*, and preferably being approximately 3cm. in over-all height by 4cm. in width. As shown in FIG. 2, the top section 66 is provided with a longitudinal slot 67 along which stanchion 8 is permitted to move. To facilitate sliding a Teflon lining 68 (FIG. 1) may be provided along the inner edge of slot 67. A support member 69 is firmly attached to and surrounds stanchion 8 at a position immediately below Teflon lining 68. As seen in FIG. 2, due to the turning moment of stanchion 8 and the parts carried thereby, it is important to design support member 69 with care and precision. While the ends of box-section 65 are preferably closed, slots (not shown) may be provided therein to permit the extremity of support member 69 to project outwardly above the screw member 7a or 7b when stanchion 8 has been moved to one or the other of the extreme ends of the slot. To achieve vertical rigidity of the system while permitting ease of sliding, angular guide members 70a and 70b may be attached as for example by screws 71 (See FIG. 5) to the respective sides of box-section 65 with smooth horizontal leg sections bearing firmly against the under side of support member 69. The lower end of stanchion 8 may be threaded, and a washer and nut 72 will serve for adjustably securing the stanchion in vertically stable but slidable condition. A scale 73 is provided on the front side of the stanchion slide assembly 3 and a pointer member 74 is carried by stanchion 8 to give an accurate reading of its transverse position.

In order to rotatably mount ball support 10 on axel 11, a washer 75 may be permanently attached to said axel. A washer 76 on the other side of said ball support 10 may be held in place by pin 77 fitted into a passage 78 in axel 11. For special uses such as in the typing of the Chinese language where it may be desirable quickly to replace one entire assembly comprising ball support 10 and its associated ball support member having the ball elements mounted thereon with another such assembly, it becomes imperative that pin 77 should be of a form which facilitates rapid removal and replacement.

While if one's requirement is merely to exchange ball elements occasionally as is the case in most routine typing, it is simpler merely to store the ball elements on a nearby ledge or the like in some reasonable order, the advantages of the highly efficient and organized procedure made possible by the present invention begins to manifest itself even in such every-day problems as the constant typing of mathematical equations. To give a specific typical example, one may desire to have available the following ball elements: 12 pitch Courier, 12 pitch italics, 12 pitch symbols, 12 pitch script, 10 pitch Courier and 10 pitch symbols. All of these elements are now commercially available and together offer a reasonable basis for typing most equations. One will find that such typing demands constant, rapid and accurate shifting such as between full size numbers and sub and superscripts, use of degree signs, brackets, integrals, capital letters, Greek letters and the like all at random. It thus becomes highly important to have at hand the instrumentality of the present invention which lends itself to highly disciplined and efficient procedure.

It might be noted that the present capabilities of the movable ball type typewriter in the field of mathematics falls far short of its excellent potential. It is noteworthy that the Style Manual of the American Institute of Physics enumerates 65 fonts of Special Characters and Signs. While is it not forseeable that the entire spectrum could be incorporated in a typewriter font assembly, it is clear that the way is now open to make available a highly sophisticated combination of fonts.

TYPING CHINESE BASIC PROBLEM

There are many problems to be faced in adapting the ball type typewriter to the typing of the Chinese language, but fortunately these problems are far from insoluable.

Perhaps the most fortuituous circumstances is that Chinese is traditionally written vertically. This leads to the tremenduous advantage that, once indicator member 75 is set at the position of the desired column, it does not require movement until the typing of the column is complete. Due to the half-space feature available on modern ball type typewriters, it is feasible in typing a vertical column to adjust the center line of the character or ideogram so it will always appear to be properly placed. This facilitates intermixing 10 pitch and 12 pitch fonts as desired without undesirable consequences.

Also, modern ball type typewriters are provided with an index key which permits selectively adjusting the vertical spacing by one-half space, one space or two spaces. This affords further flexibility in the design and typing of Chinese characters.

The first question one must ask is what limitations, if any, must be imposed on the authentic display of even the most complex characters. In a recent dictionary published in Hong Kong the most complex character shown has 32 strokes. The printer has been able to reproduce this character with complete clarity in an area measuring 0.10 by 0.10 inch. Taking into account the ability to half-space and the ability to half-index, if need be the ball element for the typewriter has the potential of printing a character having an area in the neighborhood of approximately 0.26 l inch in width by 0.36 inch in height.

Chinese characters are all derived from a collection of 214 so called "radicals" a few of which are completely obsolete. Many characters can be divided down the middle into two separate radicals or combinations of parts. Naturally, it will be desirable to present the characters as large and as clearly as possible. To accomplish this objective, resort may be made to a special technique of printing one half by striking a lower case key and then, without full back spacing, striking the "capital" of the same key. Characters warranting this treatment will be presented as "double" characters. There are a few reasonably significant "triple" characters, and they can be subjected to similar multi-key treatment.

It is also fortunate that, up to the time of the establishment of so-called "abbreviated" characters on mainland China, the combination of radical identification and number of strokes has provided an excellent basis for classifying and locating the characters. The initial discussion will be on the basis of unabbreviated characters.

UTILITY ELEMENT

An appropriate starting point in analysing the efficient approach to presenting and typing the Chinese language is to enunciate the basic objective: to enable the operator to type each character with minimum thought and effort. It immediately becomes evident that certain idiograms and symbols, including a few such as Arabic numbers originating in the Western World, should be assembled on one ball element. Therefore, the first task is to devise what may be termed a "utility element" which will carry such characters and symbols in an arrangement which will quickly become familiar to the operator.

In approaching the problem, certain systems and space-saving devices can appropriately be used. Each ball element can be identified by a distinctive color. Let the utility element be designated as "red". The ball support member 20 on which it is to be carried should be clearly marked with red.

The typewriter keys can easily be coded. The top row of twelve keys may be row *a*. The next two rows of eleven keys may be designated row *b* and row *c*, and the lowest row of ten keys may be designated row *d*. The oblique columns of keys from left to right may be numbered from 1 to 12. To call for use of a "capital", one may add + at the end of the designation. Thus, on the ordinary typewriter, if the element were designated "red" (using R for red) the code of capital Y would be R*b*6+.

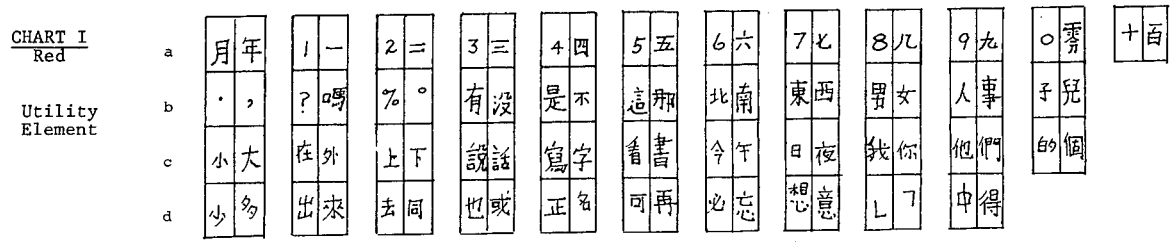

As a guide to efficient utilization of the ball elements charts are herein presented which have been prepared in accordance with the above code. A particularly interesting aspect of these charts is that, in manuscript form, the area alloted to each character measures 0.25 inch in width by 0.50 inch in height. When printed as a patent (in the United States), these areas will appear as reduced to ⅓ this size or 0.08 inch in width by 0.16 inch in height which approximates closely the area covered by the widest 12 pitch type with no use of half-spacing or half-indexing. Thus, the reduced characters will indicate the expected size when typed.

CHART I displays the characters and symbols which appear to be appropriate for the Utility element. While it is perhaps futile and even misleading to attempt to equate word by word English terms and individual Chinese characters, in respect to CHART I only this is being done. For all other charts it will be assumed that the reader can consult outside sources if he has a desire or need to know the meanings of the characters presented therein. In the following tabulation, the chart concept has been swung through 90° so that the rows appear vertically and the columns appear horizontally:

| | a | b | c | d |
|---|---|---|---|---|
| 1 | month | period | small | few |
| + | year | comma | big | many |
| 2 | 1 | ? | at | out |
| + | one | (question) | outside | come |
| 3 | 2 | % | up | (go) |
| + | two | degree | down | together |
| 4 | 3 | have | speak | and |
| + | three | (not) | word | or |
| 5 | 4 | is | read | just |
| + | four | (not) | character | name |
| 6 | 5 | this | write | able |
| + | five | that | book | again |
| 7 | 6 | north | now | certain |
| + | six | south | (noon) | forget |
| 8 | 7 | east | day | think |
| + | seven | west | night | idea |
| 9 | 8 | man | I | quote |
| + | eight | woman | you | quote |
| 10 | 9 | person | he,she,it | middle |
| + | nine | thing | (plural) | aught |
| 11 | 0 | child | (of) | |
| + | zero | (boy) | (each) | |
| 12 | ten | | | |
| + | hundred | | | |

(Note: parentheses have been placed around certain words where, without further explanation, a certain violence is being done to the Chinese language by the comparison.)

RADICALS

As has been stated, certain of the 214 radicals such, for example, as radical No. 213 (a complicated radical meaning "tortoise") have become obsolete as radicals and have significance only as a seldom-used character. Such characters can best be omitted from the radical list and simply included in more remote collections based on numbers of strokes.

The radicals can best be divided into two categories, those which are primarily meaningful and those which are primarily structural. The primarily meaningful radicals are shown in stroke order in CHART II (Blue) and the first half of CHART III (Yellow). For convenience, seven of the radicals in CHART II have also been included in CHART I. Any person familiar with the Chinese language will have no difficulty in using CHART II and the first half of CHART III without further discussion. The dividing point is radical No. 159 (vehicle) shown at B*d*10+. Vacant spaces are provided in CHART III for future adjustment.

When one faces the problem of structural radicals it is important to explain that, at this point the system of typing Chinese can turn in two directions, not necessarily mutually exclusive. One may provide a sufficient number of ball supports 10 with preselected ball elements thereon so that even the most complicated characters involve only straight-forward typing. As an alternative, combinations of radicals may be assembled in a multitude of instances to form a resultant character. Such "fabricated" character will probably rarely be as ellegant as a pre-designed character cast in type, but the facility can bring about a saving both in time and in required equipment.

To illustrate the concept of forming a composite character, the character "Ting" (meaning, to listen, to hear or to understand) has been shown adjacent the drawings. Immediately below the composite character, its coded components are shown in a form which enables one to locate them in Chart II. Movable ball type typewriters are now equipped with a special erasing ribbon and key which permits lifting the ink off the paper. With this facility at hand, one can first type the component in approximate position and then note the change required, erase and use the spacing facilities for adjustment, and then make the final typing. While this may strike one as a slow process, sight should not be lost of the fact that, in Chinese, one is typing full words whereas in English the full word emerges only after the typing of various letters.

While the composite character demonstrated adjacent the drawings is formed from meaningful radicals, many are not. Also, many radicals assume abbreviated or distorted forms when used as a component of a composite character. This explains the need for an assembly of "structural" radicals. The necessary structural radicals are shown in the last half of CHART III and in the first half of CHART IV (Green). Those familiar with the Chinese language will understand these charts without further explanation.

GENERAL CHARACTERS

As has been explained, it is advantageous to distinguish between "single" characters and "double" characters. This would not be necessary if one is content to squeeze all characters into the area which can be covered by a single stroke, but it will be assumed that the preference is to achieve a wider spread for double characters. It is apparent that there are now in general use between 2,000 and 3,000 Chinese characters many of which pertain to very specialized fields. It is believed reasonable to load the initial elements only with characters which are frequently used and to relegate the remaining characters to ball elements more remote in the system. On this basis, the last half of CHART IV and all of CHART V (Purple) have been used to demonstrate an appropriate sequence of "single" characters arranged in stroke sequence, to the extent that space is available. The next successive ball elements carrying single characters may be designated by two purple stripes, three purple stripes, etc.

CHART VI (Orange) has been prepared simply to show how the double characters may be presented. It will be noted that some of the left side abbreviations such as Y*d*6+, Y*d*7 and G*a*3, to cite a few examples, will become highly repetitive if this system is followed. An alternative would be to reserve certain keys for these components and place on the operator the burden of remembering the location of these keys. The decision will depend on the value of maximum utilization of space.

THE PROBLEM OF ABBREVIATIONS

As has been mentioned, a system of character abbreviation, beginning with 7-stroke characters, has come into vogue in mainland China. The characters have been classified under five categories which may be described as horizontal line, vertical line, left slope, dot and angular. Most occidentals are having difficulty grasping the significance of this breakdown, and it has the effect of completely destroying the radical-stroke

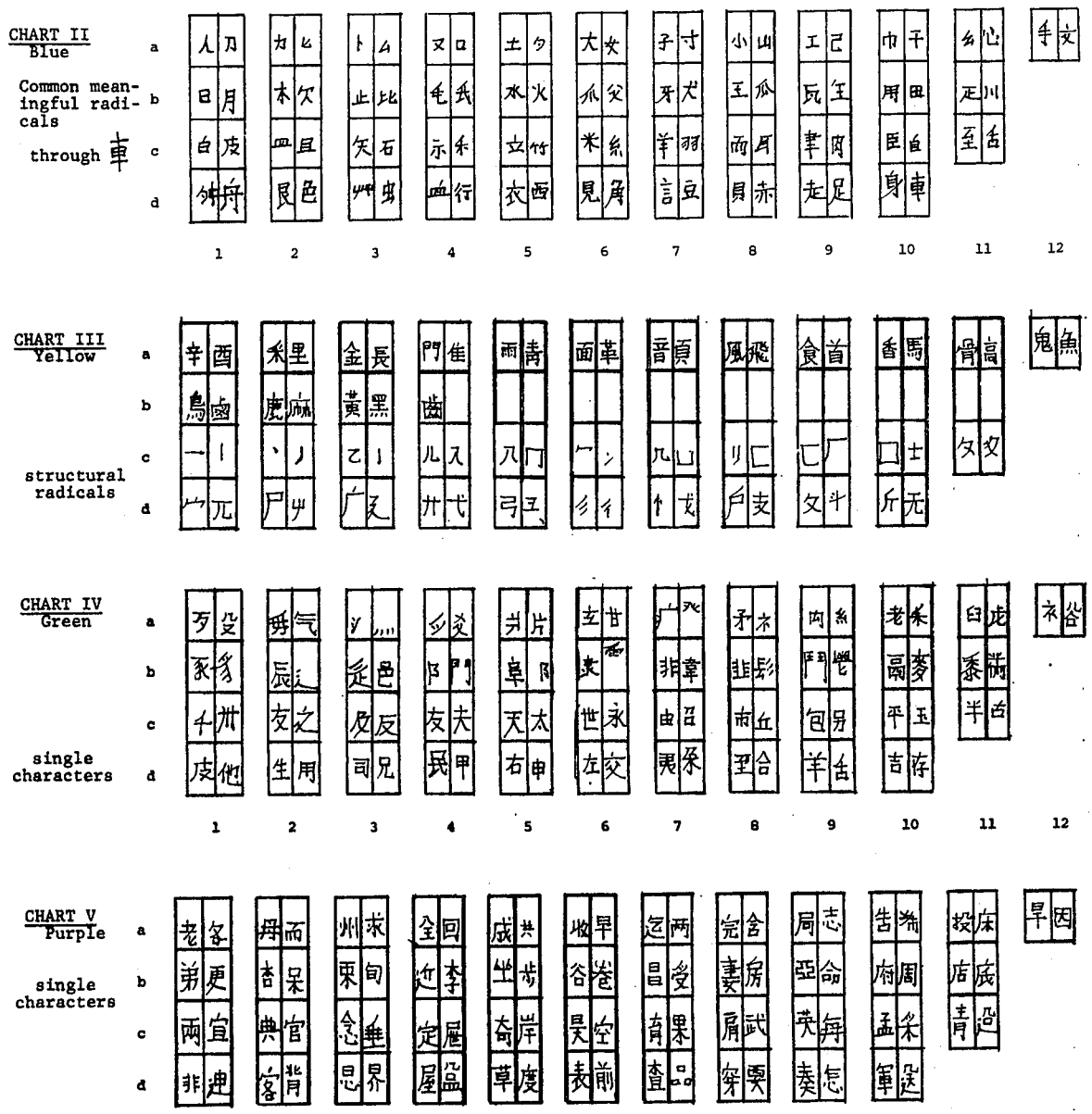

classification system. To provide a visual indication of what is involved CHART VII (colors now dispensed with) shows typical traditional characters beginning with the 7-stroke category. CHART VIII shows in corresponding positions the manner in which each of these characters has been abbreviated.

There is the promise that a surprising new benefit can emerge from the present system. Suppose a person familiar only with the traditional Chinese desires to write a letter in abbreviated characters to a recipient in mainland China. He can use the charts prepared for the radical-stroke concept but substitute ball elements which type abbreviated characters. The reverse is also feasible. The correspondent in mainland China who knows only abbreviated characters will be empowered by this system to write in the radical-stroke system without having a knowledge of the unabbreviated characters.

GENERAL PROCEDURE

The above concept may now be summarized with a brief discussion of how the system can be employed. Suppose the operator is copying from a text. Maximum speed will be realized by running through the characters to be typed and writing the initial of the ball element to be used adjacent each character. Persons working with the Chinese language acquire the ability to very quickly determine the number of strokes. Having done this, it will be advantageous to use one ball element, spacing where it is not involved, until the bottom of the column is reached. The next required ball element should then be moved to operative position and the procedure should be repeated. This approach should be pursued until all characters have been typed. Of course, the typing can be character by character but with sacrifice of speed.

Another interesting aspect, which need only be touched upon, is that persons who read no Chinese may be able to type usable Chinese. There are texts in English on "Patterns of the Chinese Language". One learns a paragon sentence and then formulates any parallel thought in the same form. Thus, using the code system and English words as a guide, it should be possible to prepare an understandable, if not elegant, Chinese text without the ability to read Chinese.

ADAPTATION TO JAPANESE

All of the work thus far done is also useful in typing Japanese. The Japanese use the same Chinese characters which, in Japanese, are known as Kan-ji. They also have a character abbreviation system which, unfortunately, is quite different from the one described above; but the same technique can be useful in dealing with the Japanese abbreviations.

The main problem is to deal with the two Japanese phonetic systems called Hira Gana and Kata Kana. Each involves fifty characters, all differing from each other. In addition, there are two modifications which apply uniformly to both systems. To produce what is termed a "turbid sound" such as changing ka to ga, shi to ji, su to zu, he to be or to to do, the equivalent of a quotation mark is placed above and after the character. To produce what are called "half turbid sounds", spe-

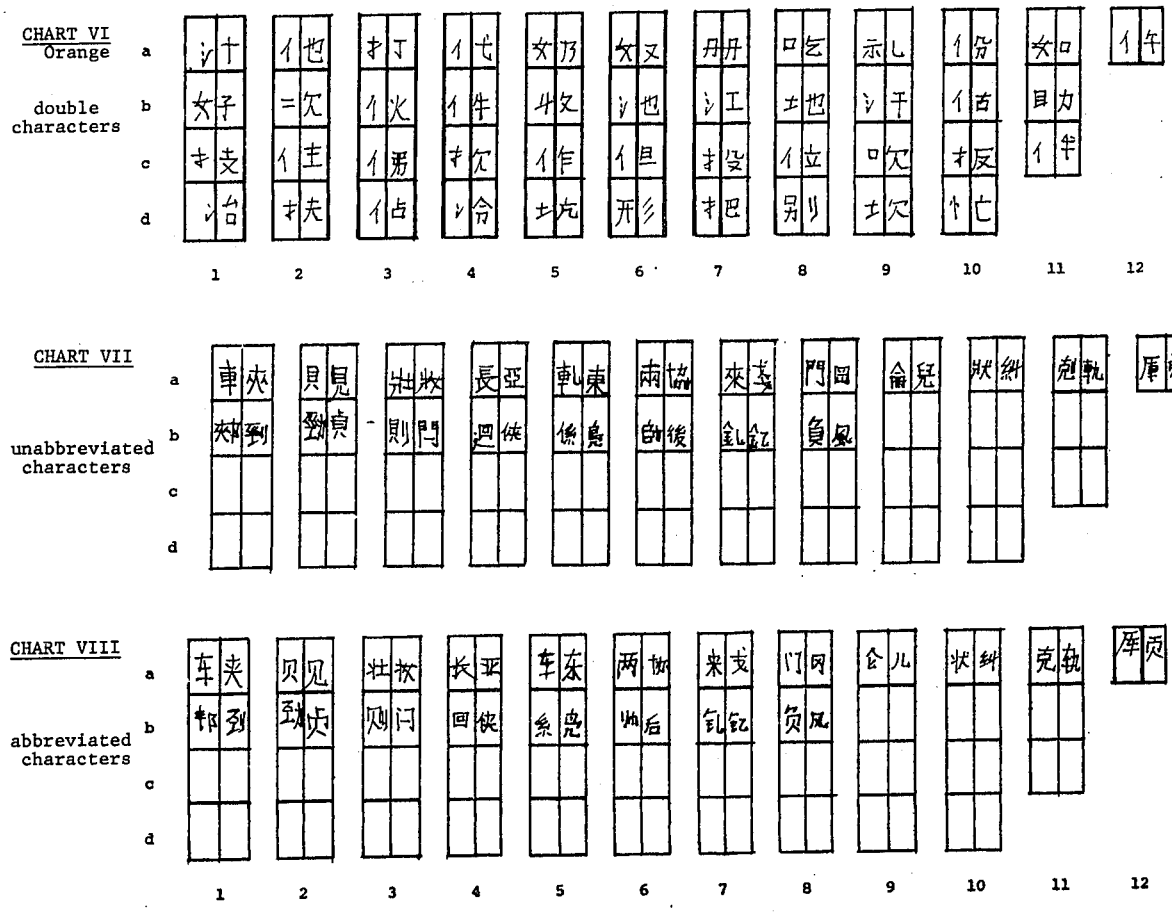

cifically to change ha to pa, hi to pi, fu to pu, he to pe and ho to po, the equivalent of a degree mark is placed above and after the character.

The Hira Gana characters are used to write the language phonetically. When Kan-ji are employed, the Hira Gana are still needed to indicate verb endings and parts of speech. The Kata Kana characters are used mainly to indicate the pronounciation of foreigh words and are thus less important than Hira Gana.

CHARTS IX and X show respectively an adaptation of the typewriter keys for either Hira Gana or Kata Kana and those regions on a ball element to which the Hira Gana characters should be assigned. The Kata Kana characters should be in the same positions on a second ball element. The keys *b*1 and *c*1 may be utilized to produce the turbid and halfturbid sounds. It will be seen that the typewriter keyboard adapts itself beautifully to the Japanese phonetic system. If one simply looks down the columns, the symmetry will be obvious. Space *c*6+ is not needed because, phonetically, the sound is the same as space *c*2. Space *b*11+ has been alotted to the "*n*" sound which is a stranger to the rest of the phonetic system. It will be an advantage in Japanese to place the Kan-ji characters for the numbers 1 to 9 to 0 immediately above the Arabic numbers.

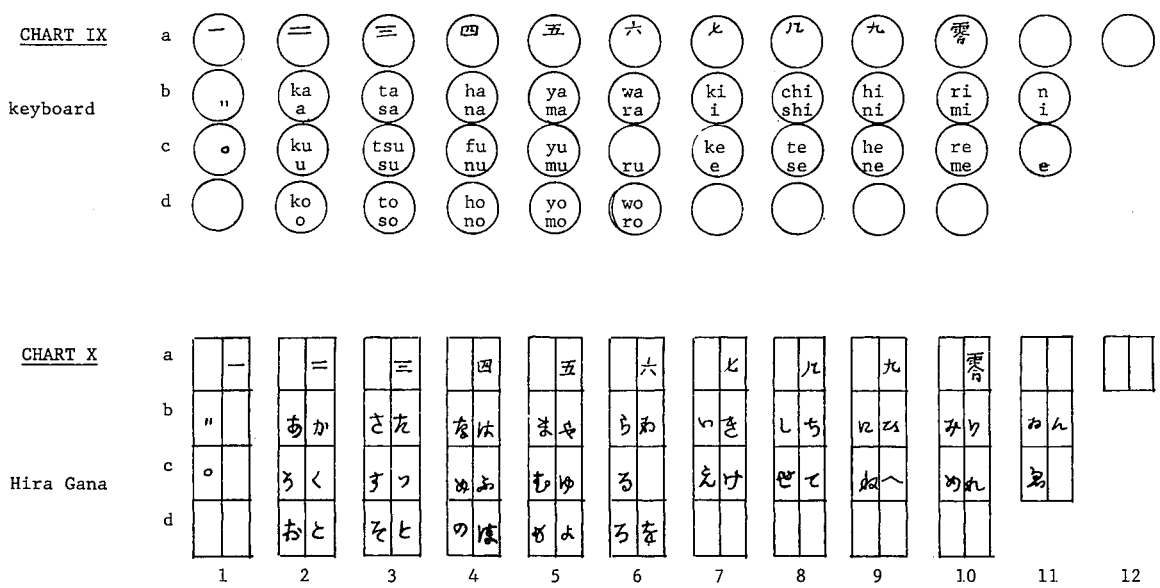

I claim:

1. Apparatus for selectively changing ball-type typing elements on a single-type- element typewriter, comprising a guide means extending transversely along the top surface of the typewriter, a substantially vertical stanchion supported for movement along said guide means to a position adjacent any print position work area of said typewriter, a ball-support assembly mounted on said stanchion and free to pivot about an axis transverse to the typewriter, and a plurality of ball support members attached to said ball support assembly and each said ball support member extending radially from a central axis and rotatable thereabout, said central axis intersecting and being perpendicular to said transverse axis, whereby said ball-support assembly may be normally positioned remotely from the work area so as not to obscure or interfere with the typing operation, but any chosen ball support member may by selective rotation about said axes be moved to and from the work area for removal and replacement of the typing elements.

2. Apparatus according to claim 1 in combination with a plurality of ball elements each of which is designed to print a part but not the whole of at least certain typed characters, said balls being positioned on the ball support assembly in coded relationship to facilitate rapid and accurate composite typing.

3. Apparatus according to claim 1 including on each ball support member a ball-releasing assembly.

4. Apparatus according to claim 1 wherein biasing means are provided for pivoting said assembly away from the work area position.

* * * * *